US006991140B2

(12) United States Patent
Bourque et al.

(10) Patent No.: US 6,991,140 B2
(45) Date of Patent: Jan. 31, 2006

(54) FITMENT FOR A FLEXIBLE POUCH WITH CHILD-SAFETY PROPERTIES

(75) Inventors: Raymond Anthony Bourque, Plymouth, MA (US); Daniel Young-Doo Chung, Chicago, IL (US); Richard M. Estabrook, Milford, MA (US); Joseph Kornick, Chicago, IL (US); Jose Tirso Olivares-Cordoba, Chicago, IL (US); Donna Lynn Visioli, Lower Gwynedd, PA (US)

(73) Assignees: E.I. du Pont de nemours and Company, Inc., Wilmington, DE (US); Kornick Lindsay, Chicago, IL (US); Ocean Spray Cranberries Inc., Lakeville, MA (US)

( * ) Notice: Subject to any disclaimer, the term of this patent is extended or adjusted under 35 U.S.C. 154(b) by 137 days.

(21) Appl. No.: 10/454,232

(22) Filed: Jun. 2, 2003

(65) Prior Publication Data

US 2004/0238564 A1 Dec. 2, 2004

(51) Int. Cl.
*B65D 47/10* (2006.01)

(52) U.S. Cl. ..... 222/541.9; 222/107; 215/48; 220/266; 383/80

(58) Field of Classification Search ..... 222/92, 222/153.05, 153.06, 153.07, 541.1, 541.5, 222/541.6, 541.9, 543, 78, 107; 215/48, 215/252, 253; 220/266, 375; 383/80, 96, 383/906, 83
See application file for complete search history.

(56) References Cited

U.S. PATENT DOCUMENTS 2,241,322 A 5/1941 Hanford
2,312,966 A 3/1943 Hanford
2,512,606 A 6/1950 Bolton et al.
3,268,125 A * 8/1966 Waldrum ..... 222/482
3,344,014 A 9/1967 Rees
3,380,646 A 4/1968 Doyen et al.
3,393,210 A 7/1968 Speck
3,645,992 A 2/1972 Elston
4,076,698 A 2/1978 Anderson et al.
4,174,358 A 11/1979 Epstein
4,207,990 A * 6/1980 Weiler et al. ..... 220/267
4,319,701 A * 3/1982 Cambio ..... 222/541.9
4,512,475 A * 4/1985 Federighi ..... 206/484
4,792,060 A * 12/1988 Brogli ..... 222/107
5,188,250 A * 2/1993 Kovacic et al. ..... 215/48
5,198,401 A 3/1993 Turner et al.
5,405,922 A 4/1995 DeChellis et al.
5,408,000 A 4/1995 Katsaros et al.
5,823,383 A 10/1998 Hins
5,897,009 A * 4/1999 O'Meara ..... 215/48
6,000,848 A 12/1999 Massioui
6,138,849 A 10/2000 Roemer et al.
6,273,307 B1 * 8/2001 Gross et al. ..... 222/566
6,874,665 B2 * 4/2005 Doherty et al. ..... 222/541.5

OTHER PUBLICATIONS

Code of Federal Regulations (CFR) in Title 16, Parts 1501 and 1500. 50, 51, 52 and 16 CFR 1500 18(a)(9).

* cited by examiner

*Primary Examiner*—Frederick C. Nicolas
*Assistant Examiner*—Melvin Cartagena

(57) ABSTRACT

Disclosed is a plastic fitment with child-safe properties for attachment to a container component of film-like plastic material, including a tubular body portion defining a through passage having axially spaced ends, a welding rib, and a cap. Also disclosed are flexible pouch or beverage package comprising the fitment and a process for using the fitment.

9 Claims, 5 Drawing Sheets

FITMENT FOR A FLEXIBLE POUCH WITH CHILD-SAFETY PROPERTIES

BACKGROUND OF THE INVENTION

1. Field of the Invention

This invention relates to fitments with child-safety properties and their use in flexible pouches and beverage packages. This invention also relates to flexible pouches and beverage packages incorporating said fitment.

2. Description of the Related Art

Fitments of this type are useful for flexible pouches for liquid or fluid or paste-like products as well as all sorts of cleaning materials. The pouches are typically intended for single-use applications. Particularly notable are pouches for beverages such as juices and other flavored drinks that are consumed directly from the pouch. Currently, flexible beverage pouches are typically provided with a plastic-wrapped pointed straw removably adhered to the pouch that is intended to pierce the pouch in a predefined location to access the contents of the pouch (see U.S. Pat. No. 3,380,646 for a representative example of such a pouch). However, these pouches may be difficult to open, particularly by children, because of the force and dexterity needed to pierce the pouch with the straw. A portion of the contents also may be ejected from the pouch due to the pressure needed to grip the pouch and insert the straw. Moreover, these pouches are not resealable if the contents are not consumed in a single serving.

Alternatively, pouches may be provided with plastic fitments to provide access to the contents. A typical fitment is designed to fit between the webs of packaging film that form the pouch. The connection between the fitment and the film forming the remainder of the pouch is generally produced by means of an ultrasonic welding process or a heat-sealing process. With known fitments, a cap (for example, a screw cap) is provided for sealing a through passage so that the latter can be repeatedly closed after opening the sealed fitment. Hermetic sealing of the through passage by means of an integrally formed, pierceable foil is also known. The pierceable foil additionally acts as a tamper-proof seal. A combination of a pierceable foil and a screw cap has also been proposed. See U.S. Pat. Nos. 6,000,848 and 6,138,849 for examples of fitments for flexible pouches.

BRIEF SUMMARY OF THE INVENTION

An object of this invention is to provide a plastic fitment of the aforesaid type having child-safety properties. A further object of the invention is to provide a child-safe, plastic fitment that is additionally provided with sealing and tamper-proof functions similar to those of a pierceable foil. Another object of the invention is to provide a child-safe plastic fitment that can be manufactured with all of the aforementioned functions as a single part using an injection molding process. A further object of the invention is to provide a child-safe, plastic fitment in which there are no loose portions thereof at any time before, during or after it is opened initially.

Accordingly, this invention provides a child-safe, plastic fitment comprising:

(a) a tubular body portion defining a through passage having axially spaced ends, said through passage is open at one of the axial ends;

(b) at least one welding rib integrally formed on said tubular body portion on the outer periphery thereof near the open end of said through passage and outwardly projecting therefrom;

(c) a cap member integrally formed on said tubular body portion near the other end of said through passage and having a base wall and a peripheral wall projecting therefrom, said cap member hermetically seals the adjacent end of said through passage in that said cap member is attached to said body portion through a circumferentially extending weakened portion adapted to break when a rotational force is exerted by hand on said cap member, and the dimensions of said cap member are adapted to those of said body portion such that said cap member can be placed onto said body portion for repeatedly sealing said through passage after it has been separated from said body portion; and (d) radially outwardly projecting, wing-like blades on said cap member at diametrically opposite positions thereof so that a person can place their fingers thereon in order to apply a rotational force to said cap member.

In accordance with a preferred embodiment of the invention, the cap member is further connected to the body portion by means of a strap extending there between. The strap provides a permanent connection between the cap member and the tubular body portion so that the two parts remain connected to one another even after the other connection in the form of the weakened portion between the cap member and the body portion has been broken.

In each case, the blades formed on the outer periphery of the cap member are designed to provide child-safety features and easy opening.

This invention also provides the use of the fitments described above in flexible pouches and beverage packages.

This invention further provides a flexible pouch comprising the fitment described above and as described in more detail below. This invention further provides a beverage package comprising: (a) a flexible pouch; (b) a fitment as described above and as described in more detail below and (c) a beverage.

DETAILED DESCRIPTION OF THE INVENTION

Figure 1:
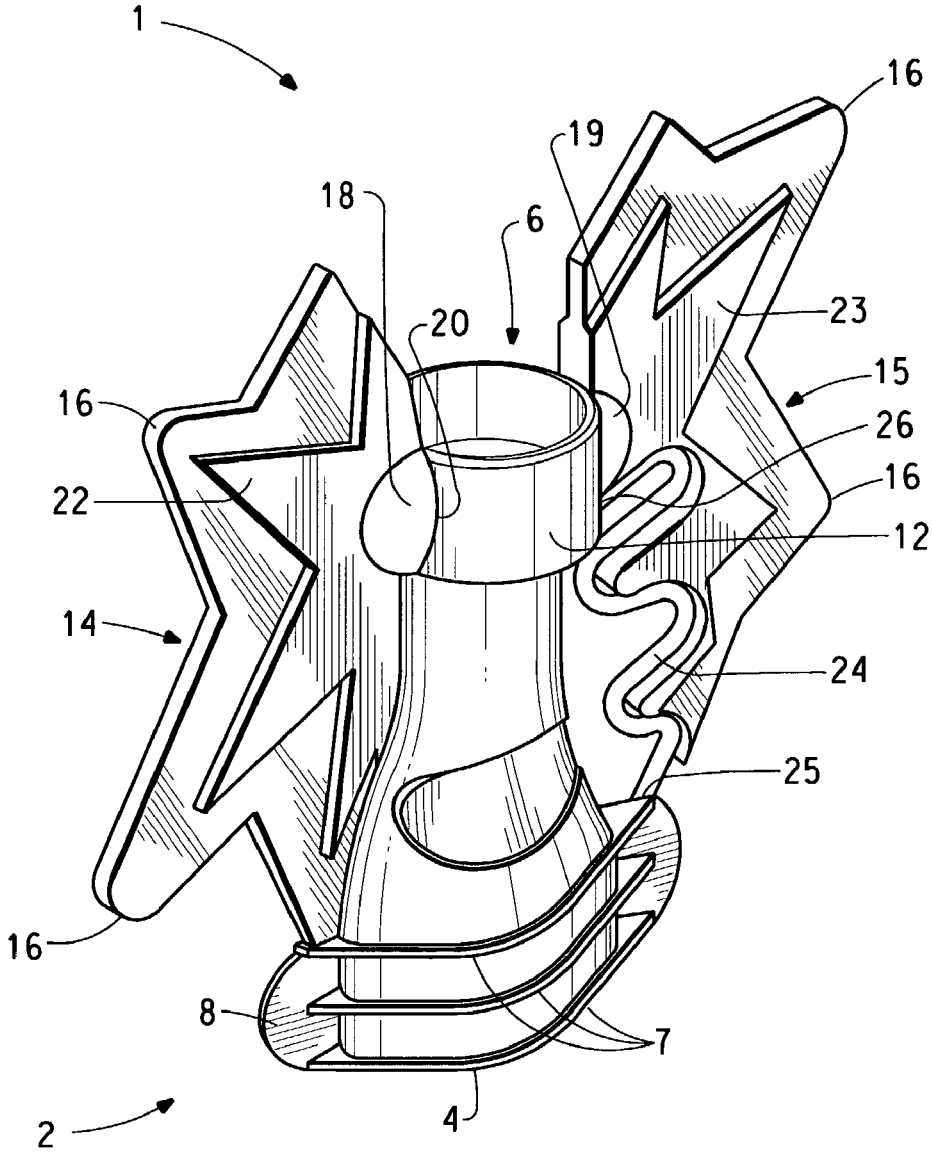
FIG. 1 represents a frontal perspective view of a fitment in accordance with a preferred embodiment of the invention.
Figure 2A:
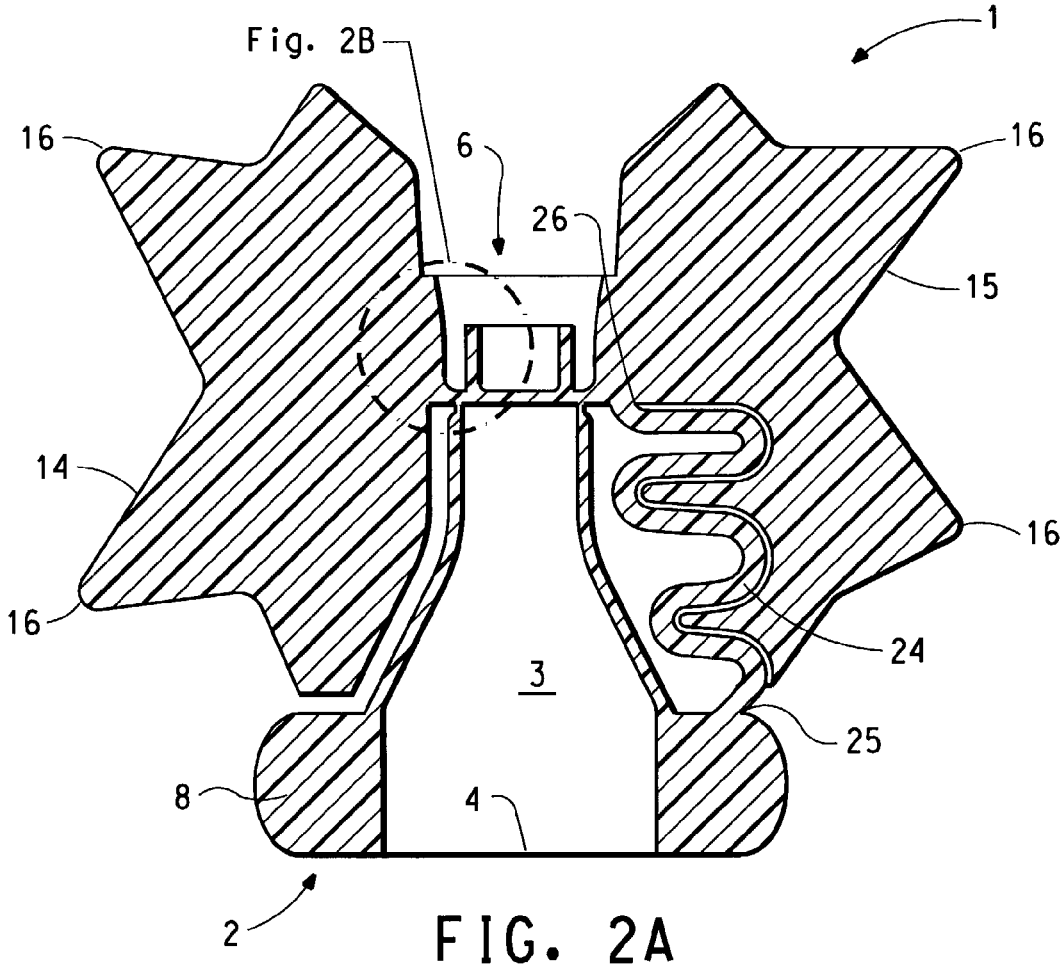
FIG. 2A represents a cross-sectional view of the fitment shown in FIG. 1 as seen through line 2—2.
Figure 2B:
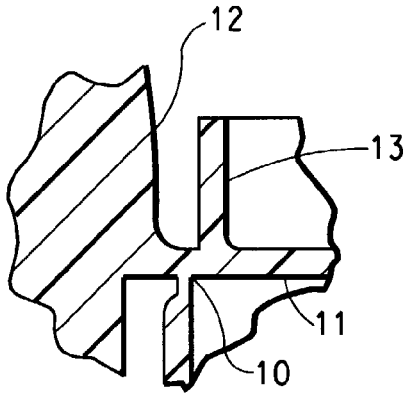
FIG. 2B represents an enlarged cross-sectional view of the seal area of the fitment shown in FIG. 2A.
Figure 3A:
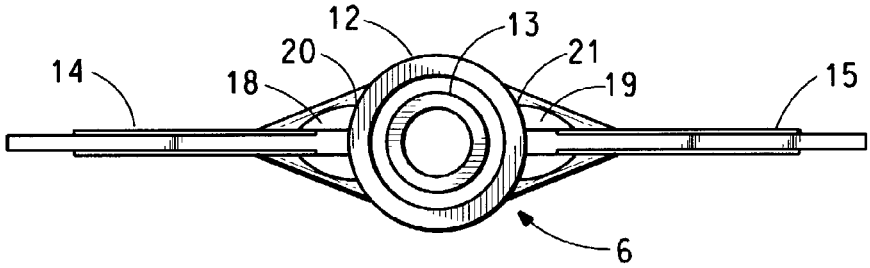
FIGS. 3A through 3C represent top, side, and bottom elevational views of the fitment shown in FIG. 1.
Figure 3B:
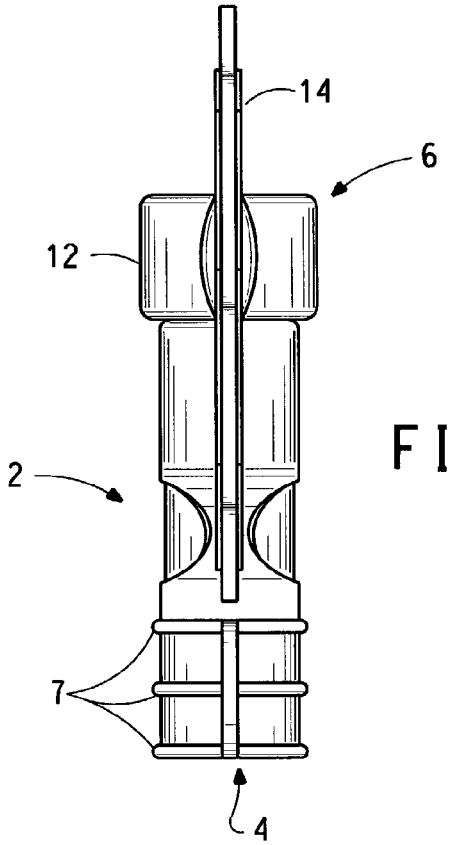
Figure 3C:
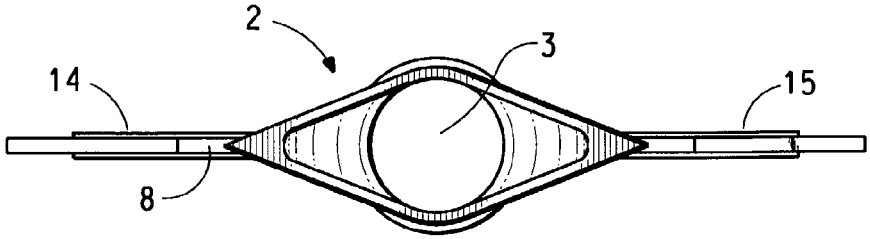

As is illustrated in FIGS. 1 through 3, a preferred fitment (generally designated by the number 1) in accordance with this invention includes a tubular body portion 2 defining a through passage 3 (see FIG. 2) which is open at one axial end 4, this being the lower one in FIGS. 1 through 3. By contrast, the opposite, other or upper axial end of the through passage 3 is hermetically sealed by a cap member 6.

Together, the body portion 2 and the cap member 6 form a one-piece molding of an appropriate synthetic material, preferably polypropylene (PP) or polyethylene (PE), including low-density polyethylene (LDPE), medium-density polyethylene (MDPE) and high-density polyethylene (HDPE). The choice of material will depend on the composition of the packaging film to which the fitment is adhered to construct a flexible pouch. One skilled in the art of packaging will be able to select the fitment material to ensure adequate adhesion between the fitment and the film. Of note are PE fitments that can be adhered to multi-layer films wherein the layer to which the fitment is adhered comprises an ionomeric resin. Of particular note are fitments prepared from polyethylene having a density of typically about 0.952 g/cc at 23° C. with a melt flow index of about 6.2.

Ionomeric resins (ionomers) are copolymers of an olefin such as ethylene and an unsaturated carboxylic acid, such as acrylic acid, or methacrylic acid, and optionally softening comonomers, that have some portion of the acidic moieties in the copolymer neutralized with metal ions such as sodium or zinc. Various ionomeric resins and blends thereof with other polymeric resins are sold by E.I. DuPont de Nemours & Company under the trademark "Surlyn®".

A plurality of axially spaced welding ribs 7 (three welding ribs in the present example) are formed integrally on a peripheral portion of the tubular body portion 2 near the open axial end 4. The welding ribs 7 may be constructed in a manner as described in more detail in U.S. Pat. No. 5,823,383 to which reference may therefore be made and incorporated herein. Partitions 8 traversing centrally through the welding ribs 7 and projecting outwardly from diametrically opposite sides of the tubular body portion 2 may be provided for strengthening the welding ribs 7 and for maintaining their relative spacing. The partition 8 may also facilitate proper joining of the fitment 1 to the packaging film to provide a pouch.

The cap member 6 is formed integrally over a circumferentially extending weakened portion 10 with the body portion 2 near the upper axial end of the through passage 3 (see FIGS. 2A and in particular 2B for enlarged details). The dimensions of the weakened portion 10 are such that it can break under a rotational force exerted manually on the cap member 6 by a user whereby the cap member 6 will be separated from the body portion 2 and the through passage 3 will be opened.

The cap member 6 includes a base wall 11 and a tubular peripheral wall 12 extending axially therefrom in a direction relative to the body portion 2. The cap member 6 thus has an essentially U-shaped or bowl-shaped cross-sectional configuration. The tubular peripheral wall 12 may have an internal dimension matched to the external dimension of the body portion 2. When the cap member 6 has been separated from the body portion 2 and oriented in an inverted position relative to the body portion 2, the tubular peripheral wall 12 can thus be placed around the body portion 2 so as to close the through passage 3. The attachment of the cap member 6 to the body portion 2 through the weakened portion 10 is effected near the outer margins of the base wall 11.

As can be seen best in FIG. 2A and in the enlarged view in FIG. 2B, the cap member 6 may also include an inner circumferential wall 13 attached to the base wall 11 having an external dimension matched to the internal dimension of the through passage 3. The circumferential wall 13 can thus be inserted into the through passage 3 so as to seal it when the cap member 6 has been separated from the body portion 2. Thus, when the cap member 6 is inverted and replaced on the body portion 2 after opening, the tubular peripheral wall 12 described above and the inner circumferential wall 13 combine to grip the body portion 2 to provide a thorough seal of the through passage 3.

As indicated above, radially projecting, wing-like blades 14 and 15 are provided on the cap member 6 at diametrically opposite positions thereof so that a person can place his fingers thereon in order to apply a rotational force to the cap member in order to facilitate a separation of the cap member 6 from the body portion 2. The blades provided on the outer periphery of the cap member are designed to provide child-safety features to the fitment. Child safety features include measures to prevent deaths and injuries to children under three years old from choking on, inhaling or swallowing small objects they may "mouth". Requirements for child-safety in the United States of America are published in the Code of Federal Regulations (C.F R.) in Title 16, Parts 1501 and 1500.50, 51, 52 and 16 C.F.R. 1500 18(a)(9).

For example, the blades 14 and 15 are sized such that the cap member does not fit completely into a cylinder, as specified in 16 C.F.R. 1501.4, that is 57.1 mm (2.25 inches) long by 31.7 mm (1.25 inches) wide and approximates the size of the fully expanded throat of a child under three years old. Furthermore, each blade comprises a plurality of lobes 16 (i.e. typically rounded projections or the like) and/or openings that provide breathing passages around the cap member should the latter be swallowed and then become lodged in the windpipe of a child, either because the cap member is intended to be used as a part separated from the fitment or has been broken off therefrom by severing the strap. FIGS. 1 through 3 illustrate blades 14 and 15 comprising lobes 16. An alternate embodiment illustrated in FIG. 4 and described more fully below, includes blades that have a plurality of openings therein.

The blades 14 and 15 may optionally comprise thereon elements of varying thickness that may be structural and/or decorative. For example, as best seen in FIGS. 1, 3A and 3B, the blades may incorporate bosses 18 and 19 at their junctions 20 and 21 with the cap member 6. These bosses strengthen the joints between the blades 14 and 15 and the cap member 6 to prevent the removal of the blades. Other raised elements, for example 22 and 23, may also facilitate gripping the blades when opening the fitment as well as being decorative.

A thin, flexible strap 24 is provided as an integral part of the fitment for permanently connecting the cap member 6 to the body portion 2. As indicated at 25, the strap 24 is formed integrally at one end with one of the welding ribs 7 and, at the other end, as indicated at 26, it is formed integrally with one of the wing-like blades 15 at one of the bosses 19 of the cap member 6, and it extends externally along the body portion 2 not in a straight line, but preferably, in the form of a meander or undulation. By this way, the strap 24 can be extended to a length that is substantially greater than the axial spacing between the connecting portions 25 and 26. The strap 24 thus allows the cap member 6 to be moved away from the body portion 2 when the weakened portion 10 has been broken.

Moreover, as can be seen from the drawings, due to its meandering or undulating form, the strap 24 gives the fitment a particularly aesthetic and distinctive appearance.

It is evident that the connecting portions 25 and 26 for the strap 24 could be provided at other axially spaced positions of the body portion 2 and the cap member 6 so long as they have a suitable axial spacing. The strap 24 may have any cross-sectional configuration, for example a circular or a flat rectangular configuration.

Figure 4:
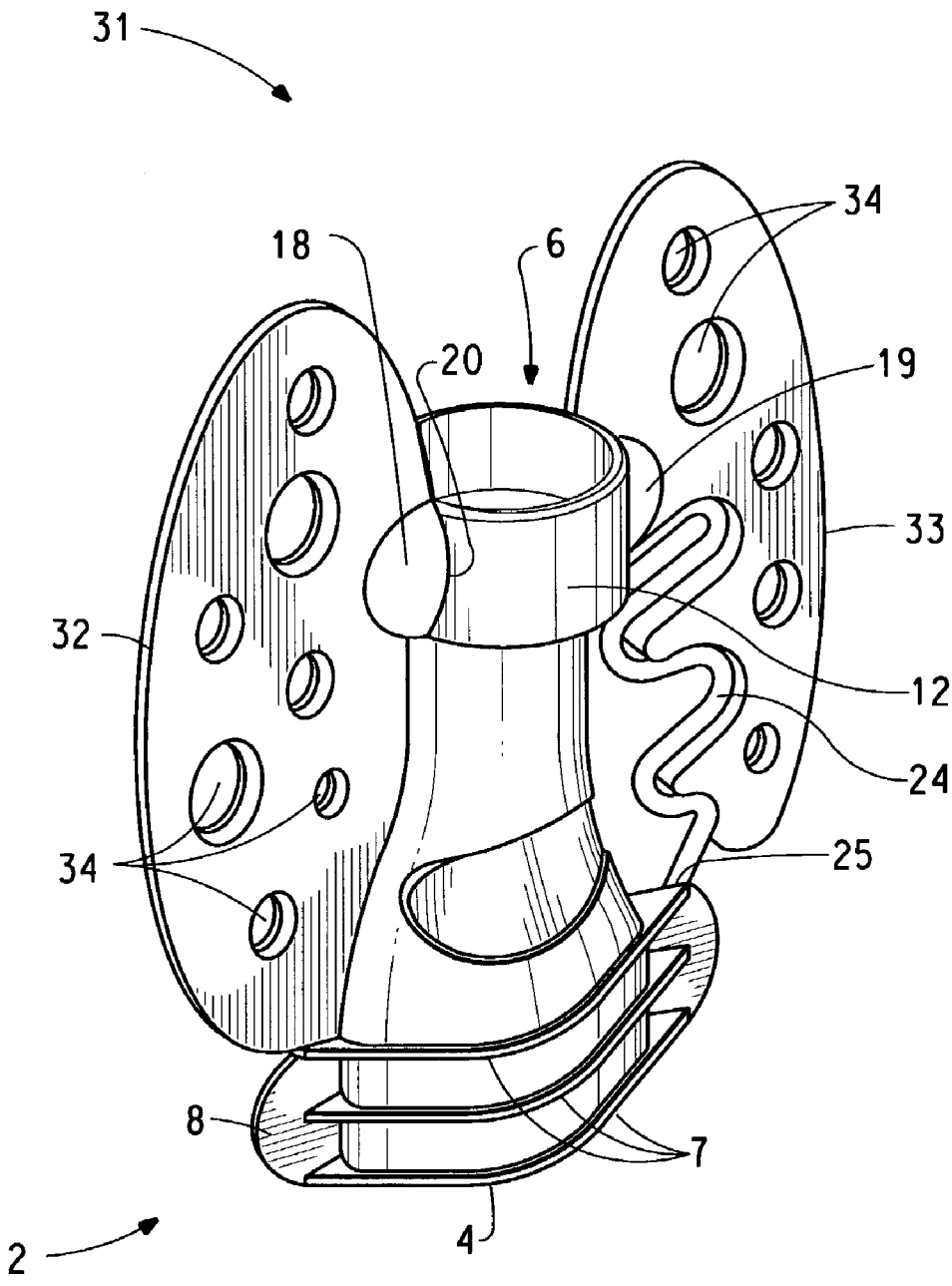
FIG. 4 represents a frontal perspective view in accordance with an alternate embodiment of the invention.
Figure 5A:
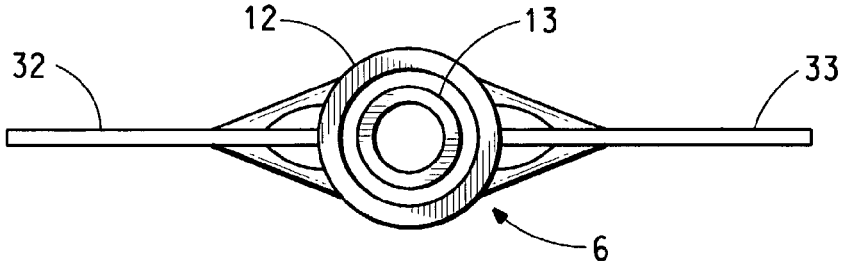
FIGS. 5A through 5C represent top, side, and bottom elevational views of the fitment shown in FIG. 4.
Figure 5B:
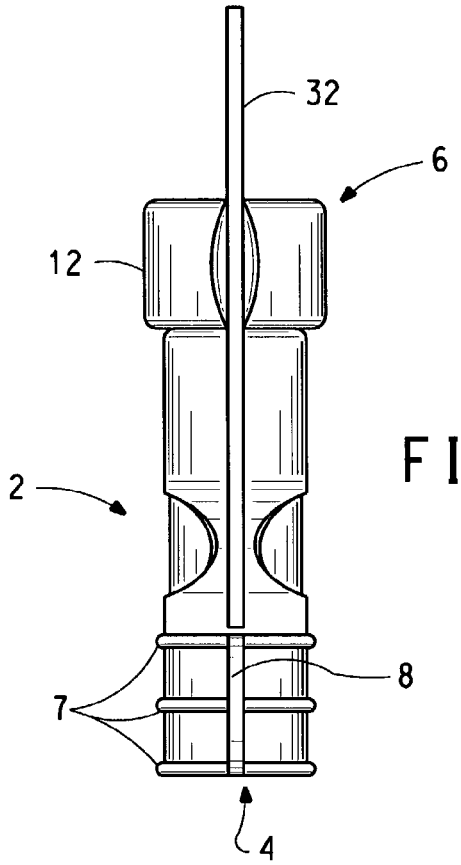
Figure 5C:
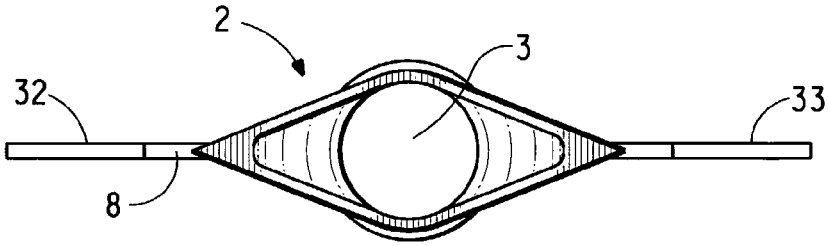

FIG. 4 illustrates a perspective drawing and FIGS. 5A, 5B, and 5C illustrate top, side and bottom perspectives of alternative embodiment of a fitment of this invention (generally designated by the number 31) in which the wing-like blades 32 and 33 comprise a plurality of openings 34. For simplicity in description, components of the fitment of this embodiment that do not change in form or function from the preferred embodiment illustrated in FIGS. 1 through 3 and described above are labeled using identical numbers.

As indicated above, this invention also provides the use of a child-safe plastic fitment described above in a flexible pouch or beverage package.

As indicated above, this invention further provides a flexible pouch comprising the fitment described above. Preferably the pouch is a stand-up pouch. Such pouches are well known in the packaging art. A stand-up pouch typically comprises a pleat or gusset in the end of the pouch opposite the fitment to provide a bottom side that the pouch can rest on to remain in a substantially vertical orientation.

Flexible pouches are constructed of flexible packaging films. For purposes of the present invention, the sheets of polymeric film employed to make the wrapper sheet of the flexible pouch, in principle, can be either a single layer or multilayer polymeric film. Also, in principle, any such film grade polymeric resin or material as generally known in the art of packaging can be employed. Preferably, a multilayer polymeric film structure is to be employed. Typically the multilayer polymeric sheet will involve at least three categorical layers including, but not limited to, an outermost structural or abuse layer, an inner barrier layer, and an innermost layer making contact with and compatible with the intended contents of the package and capable of forming the necessary seals (e.g. most preferably heat-sealable) to itself and the fitment. Other layers may also be present to serve as adhesive or "tie" layers to help bond these layers together.

The outermost structural or abuse layer is typically oriented polyester or oriented polypropylene, but can also include oriented polyamide (nylon) or paper or foil. This layer preferably is reverse printable and advantageously unaffected by the sealing temperatures used to make the package, since the package is sealed through the entire thickness of the multilayer structure. The thickness of this layer is typically selected to control the stiffness of the pouch, and may range from about 10 to about 60 $\mu$m, preferably about 50 $\mu$m.

The inner layer can include one or more barrier layers, depending on which atmospheric conditions (oxygen, humidity, light, and the like) that potentially can affect the product inside the pouch. The barrier layer also contains the contents within the pouch. Barrier layers can be, for example, metallized polypropylene (PP) or polyethylene terephthalate (PET), ethylene vinyl alcohol (EVOH), polyvinyl alcohol (PVOH), polyvinylidene chloride, aluminum foil, nylon, blends or composites of the same as well as related copolymers thereof. Barrier layer thickness will depend on factors such as the sensitivity of the product and the desired shelf life.

The structure and barrier layers can be combined to comprise several layers of polymers that provide effective barriers to moisture and oxygen and bulk mechanical properties suitable for processing and/or packaging the product, such as clarity, toughness and puncture-resistance. Examples of multilayer barrier structures suitable for use in this invention include, from outermost to innermost:

polyethylene/tie layer/polyamide/tie layer/sealant;

polyethylene/tie layer/EVOH/tie layer/sealant;

polyethylene/tie layer/polyamide/EVOH/polyamide/tie layer/sealant; and polypropylene/tie layer/polyamide/EVOH/polyamide/tie layer/sealant.

The innermost layer of the package is the sealant. The sealant is selected to have minimum effect on taste or color of the contents, to be unaffected by the product, and to withstand sealing conditions (such as liquid droplets, grease, dust, or the like). The sealant must also bond to the fitment by means of an ultrasonic welding process or a heat-sealing process. The sealant is typically a polymeric layer or coating that can be bonded to itself (sealed) at temperatures substantially below the melting temperature of the outermost layer so that the outermost layer's appearance will not be affected by the sealing process and will not stick to the jaws of the sealing bar. Typical sealants used in multilayer packaging films useful in this invention include ethylene polymers, such as low density polyethylene (LDPE), linear low density polyethylene (LLDPE), metallocene polyethylene (mPE), or copolymers of ethylene with vinyl acetate (EVA) or methyl acrylate or copolymers of ethylene and acrylic (EA) or methacrylic acid (EMA), optionally as ionomers (i.e., partially neutralized with metal ions such as Na, Zn, Mg, or Li). Typical sealants can also include polyvinylidene chloride (PVDC) or polypropylene copolymers. Sealant layers are typically from about 25 to about 100 $\mu$m thick.

Polyamides (nylon) suitable for use herein include aliphatic polyamides, amorphous polyamides, or a mixture thereof. "Aliphatic polyamides" as the term is used herein can refer to aliphatic polyamides, aliphatic copolyamides, and blends or mixtures of these. Preferred aliphatic polyamides for use in the invention are polyamide 6, polyamide 6.66, blends and mixtures thereof. Polyamides 6.66 are commercially available under the tradenames "Ultramid® C4" and "Ultramid® C35" from BASF, or under the tradename "Ube®5033FXD27" from Ube Industries Ltd. Polyamide 6 is commercially available under the tradename Capron® from Honeywell International, for example.

The film may further comprise other polyamides such as those described in U.S. Pat. Nos. 5,408,000; 4,174,358; 3,393,210; 2,512,606; 2,312,966 and 2,241,322, which are incorporated herein by reference.

The film may also comprise partially aromatic polyamides. A suitable partially aromatic polyamide is the amorphous copolyamide 6-I/6-T of the following formula.

Some suitable partially aromatic copolyamides for use in the

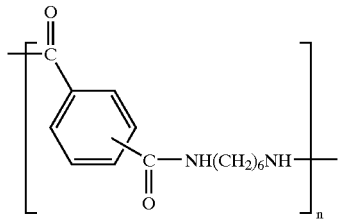

present invention are the amorphous nylon resins 6-I/6-T commercially available under the tradename Selar® PA from E.I. du Pont de Nemours and Company or commercially available under the tradename Grivory® G 21 from EMS-Chemie AG, for example.

Polyolefins suitable for use in the present invention are selected from polypropylene or polyethylene polymers and copolymers comprising ethylene or propylene. Polyethylenes useful for use herein can be prepared by a variety of methods, including well-known Ziegler-Natta catalyst polymerization (see for example U.S. Pat. No. 4,076,698 and U.S. Pat. No. 3,645,992), metallocene catalyst polymerization (see for example U.S. Pat. No. 5,198,401 and U.S. Pat. No. 5,405,922) and by free radical polymerization. Polyethylene polymers useful herein can include linear polyethylenes such as high density polyethylene (HDPE), linear low density polyethylene (LLDPE), very low or ultralow density polyethylenes (VLDPE or ULDPE) and branched polyethylenes such as low density polyethylene (LDPE). The densities of polyethylenes suitable for use in the present invention range from 0.865 g/cc to 0.970 g/cc. Linear polyethylenes for use herein can incorporate alpha-olefin comonomers such as butene, hexene or octene to decrease their density within the density range so described. The impermeable film useful in the present invention can comprise ethylene copolymers such as ethylene vinyl acetate and ethylene methyl acrylate and ethylene (meth)acrylic acid polymers. Polypropylene polymers useful in the practice of the present invention include propylene homopolymers, impact modified polypropylene and copolymers of propylene and alpha-olefins.

Ionomeric resins ("ionomers") are copolymers of an olefin such as ethylene and an unsaturated carboxylic acid, such as acrylic acid or methacrylic acid and optionally softening monomers wherein at least one or more alkali metal, transition metal, or alkaline earth metal cations, such as sodium, potassium or zinc, are used to neutralize some portion of the acidic groups in the copolymer, resulting in a thermoplastic resin exhibiting enhanced properties. For example, "Ethylene/(meth)acrylic acid (abbreviated E/(M)AA)" means a copolymer of ethylene (abbreviated E)/acrylic acid (abbreviated AA) and/or ethylene/methacrylic acid (abbreviated MAA) which are at least partially neutralized by one or more alkali metal, transition metal, or alkaline earth metal cations to form an ionomer. Terpolymers can also be made from an olefin such as ethylene, an unsaturated carboxylic acid and other comonomers such as alkyl (meth)acrylates to provide "softer" resins that can be neutralized to form softer ionomers. Ionomers are known conventionally and their method of preparation is described in, for example, U.S. Pat. No. 3,344,014.

Anhydride or acid-modified ethylene and propylene homo- and co-polymers can be used as extrudable adhesive layers (also known as "tie" layers) to improve bonding of layers of polymers together when the polymers do not adhere well to each other, thus improving the layer-to-layer adhesion in a multilayer structure. The compositions of the tie layers will be determined according to the compositions of the adjoining layers that need to be bonded in a multilayer structure. One skilled in the polymer art can select the appropriate tie layer based on the other materials used in the structure. Various tie layer compositions are commercially available under the tradename Bynel® from E.I. du Pont de Nemours and Company, for example.

Polyethylene vinyl alcohol ("EVOH") having from about 20 to about 50 mole % ethylene can be suitable for use herein. Suitable polyethylene vinyl alcohol polymers are commercially available under the tradename Evalca® from Kuraray or commercially available under the tradename Noltex® from Nippon Goshei, for example.

Polyvinylidene chloride (PVDC) polymers and copolymers suitable for use herein as coatings or films can be obtained commercially from Dow Chemical under the tradename Saran®, for example.

Films useful in the present invention can additionally comprise optional materials, such as the conventional additives used in polymer films including: plasticizers, stabilizers, antioxidants, ultraviolet ray absorbers, hydrolytic stabilizers, anti-static agents, dyes or pigments, fillers, fire-retardants, lubricants, reinforcing agents such as glass fiber and flakes, processing aids, antiblock agents, release agents, and/or mixtures thereof.

A laminate film useful in the present invention can be prepared by coextrusion as follows: Granulates of the various components are melted in extruders. The molten polymers are passed through a die or set of dies to form layers of molten polymers that are processed as a laminar flow. The molten polymers are cooled to form a layered structure. Molten extruded polymers can be converted into a film using a suitable converting technique. For example, a film useful in the present invention can also be made by (co)extrusion followed by lamination onto one or more other layers. Other suitable converting techniques are, for example, cast film extrusion, cast sheet extrusion and extrusion coating.

The thermoplastic film may also be laminated to a substrate such as foil, paper or nonwoven fibrous material to provide a packaging material useful in this invention. The packaging material may also be processed further by, for example but not limitation, printing, embossing, and/or coloring to provide a packaging material to provide information to the consumer about the product therein and/or to provide a pleasing appearance of the package.

Preferably, a film useful in this invention can be processed on a film fabrication machine at a speed from about 5 meters per minute (m/min) to a speed of about 200 m/min.

Pouches of this invention can be prepared by providing a continuous web of packaging film in which the film is oriented in a U- or V-shaped trough. A stand-up pouch of the present invention can be prepared by providing a continuous web of packaging film in which the film comprises a gusset or pleat to provide a W-shaped trough.

The continuous web of packaging film used to prepare a flexible pouch useful in this invention may comprise a single sheet of film that is oriented into a trough as described above. Alternatively, the web may comprise two or three sheets of packaging film that are bonded together by, for example, heat sealing seam(s) at the bottom of the trough. In this alternative, the sheets may be the same or different. For example, one sheet may be opaque, optionally with graphic elements, and another sheet may be transparent to allow visualization of the contents of the pouch. A particular form of stand-up pouch comprises three sheets of packaging film, one of which forms the bottom of the pouch and is pleated, and two that form the sides of the pouch. The sheets are joined together by two seams at the bottom of the trough. The seams provide sufficient rigidity to the pouch to enable it to stand upright.

The trough-shaped web is divided into receptacles the size of individual pouches by transverse seals prepared typically by means of heat sealing. Single-serving pouches are typically about 10 to 16 cm tall, about 7 to 10 cm wide with a generally triangular cross section about 4 to 5 cm in depth and contain about 150 to 250 mL of liquid. For example, a pouch can be about 14 cm tall, 9 cm wide and contain 200 mL of liquid, to provide a single serving for a child. Pouches may also be larger, to contain larger amounts (for example, a pouch may contain more than a single serving). Preferably, the desired amount of the contents of the pouch is placed into the receptacle, typically by means of a metering valve. The fitment is inserted between the margins of the film web, and a top seal of the pouch is made by sealing the fitment to the margins of the web and sealing the margins to each other. The individual pouches are cut from the web by means of transverse cutters. The operations of forming, filling and sealing the pouch can be prepared by performing the steps described above concurrently and/or sequentially.

In an alternative embodiment, the pouch may be prepared, a fitment inserted and the pouch subsequently filled. The "preformed" pouch of this embodiment is prepared generally as described above, in which flexible packaging film(s) are formed into a pouch shape and the fitment inserted between the ends of the film(s) and joined to the film(s), for example by heat sealing. In this embodiment, portions of the film margins are not sealed together, providing an opening for subsequent filling of the pouch. For example, the fitment is inserted and joined to the pouch at the junction of a transverse seal and the open end of the pouch, and the remainder of the open end is left unsealed. The pouch may also be shaped so that the fitment is inserted and sealed in a diagonal corner of the open end of the pouch. Pouches prepared in this embodiment can be collected and transported to a separate filling operation to be filled with contents. In the filling operation, the desired amount of the contents of the pouch is placed into the pouch through the opening, typically by means of a metering valve. The opening is sealed by joining the margins of the film(s) that form the opening (for example, by heat sealing) to form a top seal.

Pouch making equipment such as that made by Totani Corporation, Kyoto, Japan or Klockner Barlelt Co., Gordonsville, Va. can be advantageously used practicing this invention.

As indicated above, this invention further provides a beverage package comprising (a) flexible pouch (b) a fitment as described above and (c) a beverage. The package of this invention is prepared as described above wherein the content of the pouch is a beverage.

The beverage can be any liquid for drinking, such as water, fruit or vegetable juices or juice drinks, soy-based products, dairy products, other flavored drinks and the like, optionally including additional ingredients such as nutrients, electrolytes, vitamins, fiber, flavoring agents, coloring agents, preservatives, antioxidants and the like suitable for human consumption.

Although the invention has been described hereinabove on the basis of preferred and alternate embodiments, it is evident that it is not restricted thereto. On the contrary, alterations and modifications may be made by a skilled person within the framework of the above teachings without thereby departing from the spirit and essence of the invention.

We claim:

1. A child-safe plastic fitment comprising:

(a) a tubular body portion defining a through passage having axially spaced ends, said through passage is open at one of the axial ends;

(b) at least one welding rib integrally formed on said tubular body portion on the outer periphery thereof near the open end of said through passage and outwardly projecting therefrom;

(c) a cap member integrally formed on said tubular body portion near the other end of said through passage and having a base wall and a peripheral wall projecting therefrom, said cap member hermetically seals the adjacent end of said through passage in that said cap member is attached to said tubular body portion through a circumferentially extending weakened portion adapted to break when a rotational force is exerted by hand on said cap member, and the dimensions of said cap member are adapted to those of said body portion such that said cap member can be placed onto said tubular body portion for repeatedly sealing said through passage after it has been separated from said tubular body portion; and (d) radially outwardly projecting, wing-like blades on said cap member at diametrically opposite positions dimensioned so that a person can place his fingers thereon to gain additional mechanical leverage when a rotational force to said cap member wherein said blades comprise a plurality of lobes dimensioned to prevent lodging of the cap in a child's wind pipes and a plurality of openings therein, or a combination of lobes and openings to provide breathing passages.

2. A child-safe plastic fitment in accordance with claim 1 wherein said cap member is permanently connected in one-piece manner to said tubular body portion through a strap extending there between.

3. A child-safe plastic fitment in accordance with claim 2, wherein said strap extends externally of said tabular body portion between a connecting portion on said cap member and a connecting portion axially spaced therefrom on said tubular body portion.

4. A child-safe plastic fitment in accordance with claim 3, wherein an extended length of said strap is substantially greater than the axial spacing of the connecting portions of said strap.

5. A child-safe plastic fitment in accordance with claim 4, wherein said strap has a substantially meandering form between the connecting portions.

6. A child-safe plastic fitment in accordance with claim 1, wherein said peripheral wall of said cap member has an internal dimension matched to the external dimension of said tubular body portion so as to close said through passage when said cap member is placed over said tubular body portion.

7. A process comprising attaching a child-safe plastic fitment to a flexible pouch or beverage package wherein the child-safe plastic fitment is as recited in claim 1, 2, 3, 4, 5, or 6.

8. A flexible pouch or beverage package comprising the child-safe plastic fitment of claim 1, 2, 3, 4, 5, or 6.

9. A beverage package comprising: (a) a flexible pouch; (b) a child-safe plastic fitment of claim 1, 2, 3, 4, 5, or 6, and (c) a beverage.

* * * * *

UNITED STATES PATENT AND TRADEMARK OFFICE

CERTIFICATE OF CORRECTION

PATENT NO. : 6,991,140 B2
APPLICATION NO. : 10/454232
DATED : January 31, 2006
INVENTOR(S) : Bourque Raymond Anthony et al.

It is certified that error appears in the above-identified patent and that said Letters Patent is hereby corrected as shown below:

Col. 10, Claim 3, line 31, "said tabular" should read -- said tubular --.

Signed and Sealed this

Sixth Day of February, 2007

JON W. DUDAS
*Director of the United States Patent and Trademark Office*